US009814646B2

(12) United States Patent
Delolmo

(10) Patent No.: US 9,814,646 B2
(45) Date of Patent: Nov. 14, 2017

(54) SYSTEM FOR SECURELY POSITIONING A CERVICAL SPINE DURING SURGERY

(71) Applicant: Delolmo Holdings, LLC, Albuquerque, NM (US)

(72) Inventor: Lorenzo Delolmo, El Paso, TX (US)

(73) Assignee: Delolmo Holdings, LLC, Albuquerque, NM (US)

( * ) Notice: Subject to any disclaimer, the term of this patent is extended or adjusted under 35 U.S.C. 154(b) by 371 days.

(21) Appl. No.: 14/327,604

(22) Filed: Jul. 10, 2014

(65) Prior Publication Data

US 2015/0013686 A1 Jan. 15, 2015

Related U.S. Application Data

(60) Provisional application No. 61/844,559, filed on Jul. 10, 2013.

(51) Int. Cl.
*A61G 13/12* (2006.01)

(52) U.S. Cl.
CPC ..... *A61G 13/121* (2013.01); *A61G 13/1265* (2013.01)

(58) Field of Classification Search
CPC ..... A61F 2005/0167; A61F 5/0102; A61F 2005/0139; A61F 5/0125; A61F 5/04; A61H 1/0218; A61H 1/0292; A61H 1/0229; A61H 2201/1607; A61G 13/12; A61G 13/121; A61G 13/1245; A61G 13/1235; A47C 15/008
See application file for complete search history.

(56) References Cited

U.S. PATENT DOCUMENTS

| | | | | |
|---|---|---|---|---|
| 5,147,287 | A * | 9/1992 | Jewell | A61G 13/12 5/622 |
| 5,207,716 | A * | 5/1993 | McReynolds | A61F 5/3707 128/870 |
| 5,569,176 | A | 10/1996 | Graham | |
| 5,713,841 | A * | 2/1998 | Graham | A61H 1/0218 128/DIG. 20 |
| 5,906,586 | A | 5/1999 | Graham | |
| 8,100,846 | B1 * | 1/2012 | Lamonica | A61F 5/048 128/845 |
| 2005/0072433 | A1 * | 4/2005 | Ingwersen | B60N 2/48 128/845 |

* cited by examiner

*Primary Examiner* — Ophelia A Hawthorne
(74) *Attorney, Agent, or Firm* — Deborah A. Peacock; Justin R. Jackson; Peacock Myers, P.C.

(57) ABSTRACT

A system for securely positioning a cervical spine during surgery includes a donut-shaped frame to receive and hold a patient's head, straps integrated into the donut-shaped frame to securely hold a patient's head within the harness at least one of a patient's chin and forehead, a rubber bladder can integrated with the harness locatable beneath a patient's neck, and a pump to provide air into the rubber bladder. Air pumped into the rubber bladder by the pump can cause a patient's neck to be lifted into an arch in preparation for and during cervical spine surgery. A release valve can be provided to release air from the rubber bladder and lower a patient's neck during and after surgery. Rods can be integrated into the donut-shaped frame at each side of the rubber bladder. The rods can affix the harness to an operating table.

20 Claims, 4 Drawing Sheets

SYSTEM FOR SECURELY POSITIONING A CERVICAL SPINE DURING SURGERY

INVENTION PRIORITY

The present invention claims priority as a continuation application to U.S. Provisional Patent Application No. 61/844,559, entitled "System for Securely Positioning a Cervical Spine During Surgery," which was filed Jul. 10, 2013 and is incorporated herein in its entirety.

FIELD OF THE INVENTION

The present invention is related to operating room technology utilized during surgery to support and position a patient. The present invention is also related to harnesses, racks, and operating tables. More particularly, the present invention is related to a system for securely supporting and positioning a patient's cervical spine during surgery.

BACKGROUND

Spinal surgery is sometimes necessary for a number of reasons including to repair disks, to fuse vertebrates, relieve pressure on the spinal cord caused by bone growth or bulging disks, and nervous system repair. Spinal surgery is complicated and requires that a patient be secured in a manner that will prevent the patient's movement in order to improve surgical success and avoid accidental injury to the patient's spine and nervous system caused by blades, tools or laser beams.

Cervical spine surgery is generally performed to treat nerve/spinal cord impingement (via decompression surgery) and/or spinal instability (via fusion surgery). The two procedures are often combined, as decompression may destabilize the spine and create the need for a fusion to add stability. Spinal instrumentation, such as the installation of a small plate over vertebrates, can also be used to help add stability to the spinal construct. Spinal surgery in the neck area of a patient is considered one of the most complicated and difficult spinal procedures. Complication exists because the patient's neck must be supported in a manner that will lift and arch the spine to thereby spread the vertebrates so that surgery can be performed. Presently, a patient's head is typically supported underneath the neck by a rolled towel and the patient's head is secured to the operating table with adhesive tape or straps. Such a makeshift manner of supporting a patient's neck in an arch while securing the patient's head is not effective and can result in risk to the patient as surgery is performed. Furthermore, fluids and blood can be absorbed by the neck-supporting towel, which is messy and can present a risk of infection. What is needed is a better system that can accomplish neck support and head restraint during surgery.

SUMMARY

It is a feature of the present invention to provide a system for securely supporting and positioning a patient's cervical spine during surgery.

It is also a feature of the present invention to provide a system for securely holding a patient's head while supporting and positioning a patient's cervical spine during surgery.

In accordance with features of the present invention, a system includes a harness having a holding area to receive and hold a patient's head, straps to stabilize the patient's chin and forehead, and a rubber bladder that can selectively position and support the patient's neck at various levels by filling the rubber bladder with air or removing air from the rubber bladder.

It is another feature of the present invention to further secure the harness to an operating table with rods integrated in the harness on each side of the holding area that can be inserted into rod receivers integrated with an operating room table.

It is yet another feature of the present invention for a back of the holding area to be comprised of a woven mesh to enable fluids to drain away from the patient's head and neck area.

It is yet another feature of the present invention to include a pump to selectively fill the rubber bladder with air to lift the neck and accomplish optimum cervical spine arch and spread for surgery.

It is yet another feature of the present invention to include a release valve to selectively remove air from the rubber bladder to lower the neck and accomplish optimum cervical spine arch and spread, and to remove air completely from the rubber bladder when surgery is completed.

It is yet another feature of the present invention for the harness and rubber bladder to be made with materials that enable imaging of a patient's cervical spine during a surgical procedure.

These and additional features will become apparent from the following description and the drawings.

DETAILED DESCRIPTION OF THE INVENTION

Figure 1:
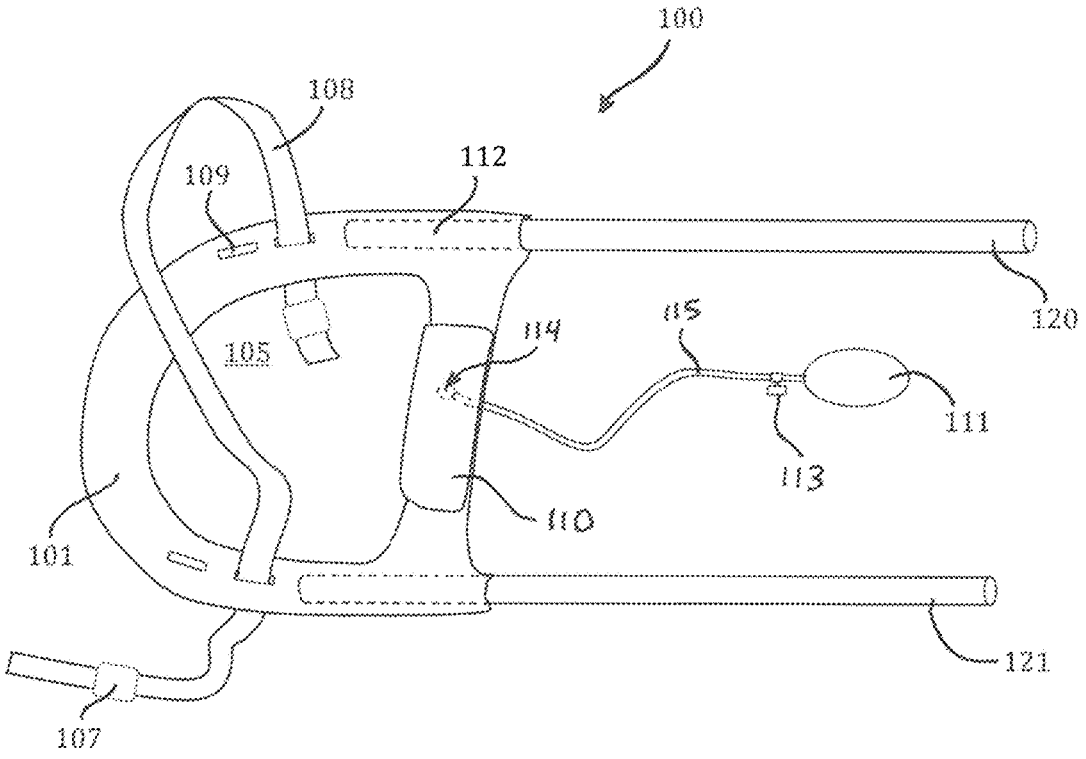
FIG. 1 illustrates a perspective view of the system for securely positioning a cervical spine during surgery.

Referring to FIG. 1, a perspective view of a system 100 in accordance with features of the present invention is illustrated. The system 100 for securely supporting and positioning a patient's cervical spine during surgery can include a harness 101 provided almost in the form of a donut-shaped frame for receiving and securely holding a patients head (not shown) while also supporting and positioning a patient's cervical spine (the back area of a patient's neck) via an air inflatable and adjustable rubber bladder 110 during surgery. A harness frame 101 can be padded, or the frame 101 can simply be made of soft plastic, and it can have a holding area 105 that can include padding, mesh or other support material therein as a head-supporting medium to receive and support the back of a patient's head.

Figure 2:
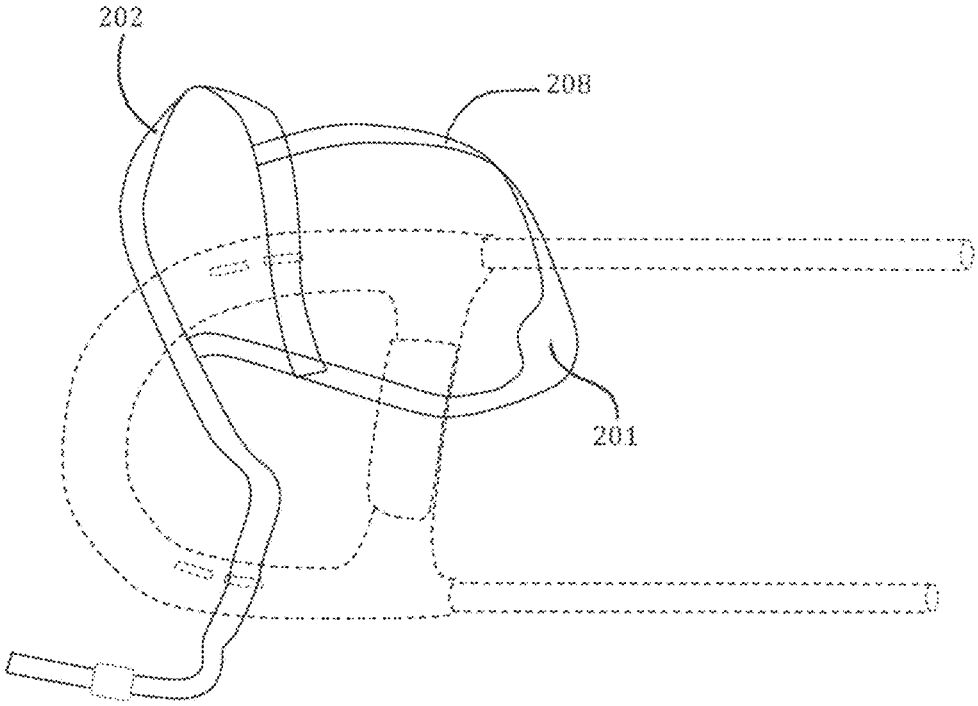
FIG. 2 illustrates a perspective view of a head and chin strap used in association with the harness to secure a patient's head to the harness, in accordance with a feature of the present invention

The adjustable rubber bladder 110 can be inflated using a hand pump, similar to hand pumps 111 and turn-valve 113 combination of hardware used with standard blood pressure measuring devices. The pump and valve can be connected to the back side 114 (shown by dashed lines) of the adjustable bladder via a rubber hose 115 where pressure control can be managed from beneath the patient and operating area (e.g., controlled typically by a surgery technician). It should be appreciated that the bladder pump can also be electro-mechanical and include sensors to maintain constant pressure over the bladder. At least one strap 108 can be used in association with the frame 101 to securely hold a patient's head onto the harness. The strap 108 can be routed through slots 109 formed in the housing 101. Several slots 109 can be located along the frame 101 to provide flexibility and adjustability for various patient head sizes. Tension on a patient's forehead can be adjusted using strap adjustment hardware 107, such a buckles, Velcro™, buttons, etc. Referring to FIG. 2, an alternate embodiment for a strap 208 can include a chin restraint portion 201 for securing a patient's chin into the harness 100 to prevent movement during a procedure. The strap also includes a forehead restraint portion 202 to secure the patient's head onto the harness 100. Securing both a patient's head and chin may afford the best security over a patient's head during surgery.

Figure 5:
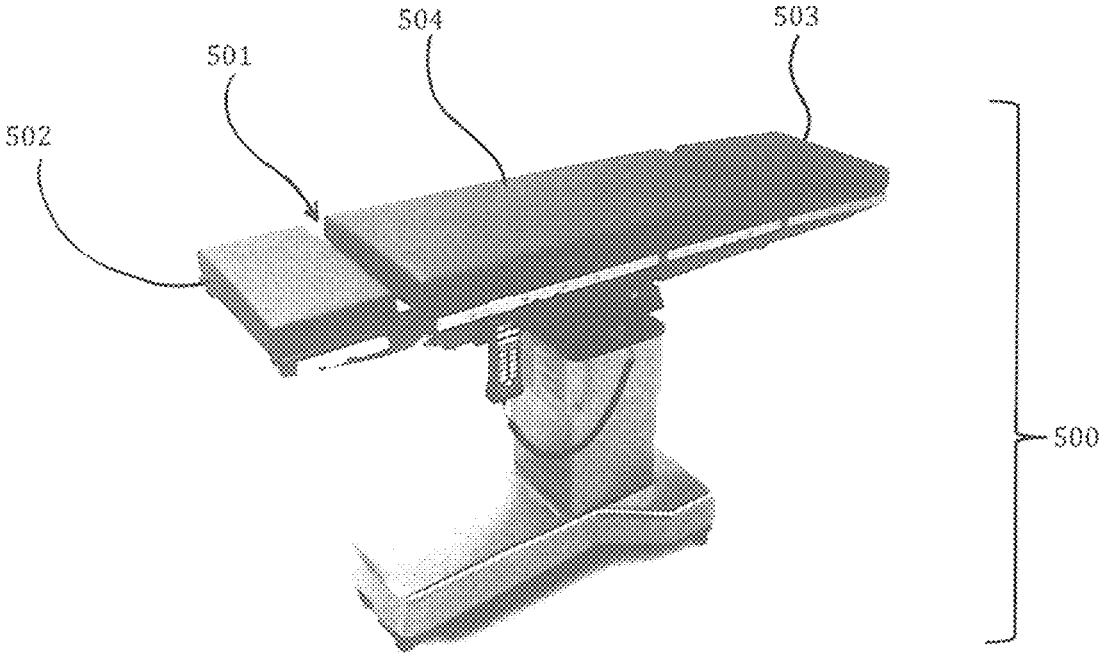
FIG. 5 Prior Art
FIG. 5, labeled prior art, illustrates a typical operating table used for surgery, wherein a head section of the table can be removed from the table and replaced with the system illustrated in FIGS. 1-4 using bars integrated therein.

Referring back to FIG. 1, at least one rod 120/121 can be provided to secure the harness 100 to an operating table 500 similar to that shown in FIG. 5 (labeled as "prior art"). The rods can be integrated into the harness as indicated by numeral 112 during manufacturing, or when molding of the harness 101. A rod can be located at each side of the harness (which would also be generally at each side of a patient's head when located in the harness). Two rods 120/121 are shown in FIG. 1 because the standard operating table includes two standard rod receivers. Referring to FIG. 5, a prior art photograph of a standard operating table 500 is shown. As indicated in an area of the operating table 500 by numeral 501, hardware is integrated into the operating table to accept rods similar to those indicated in the harness 100 for the padded head section 502 to be installed or removed from the main section 504 of the operating table 500. The head section 502 and foot section 503 of the operating table can each be removed from the table depending on the nature of the surgical procedure being performed. Both sections are secured to the operating table by the same two-rod configuration similar to that shown on the harness 101, which is the subject of this invention. Using the same rod configuration assures interchangeability of the present invention with standard operating tables, although it should be appreciated that other hardware can be utilized to secure the harness to an operating table. A single rod, for example, may be all that is required to secure the harness 101 to an operating table.

Figure 3:
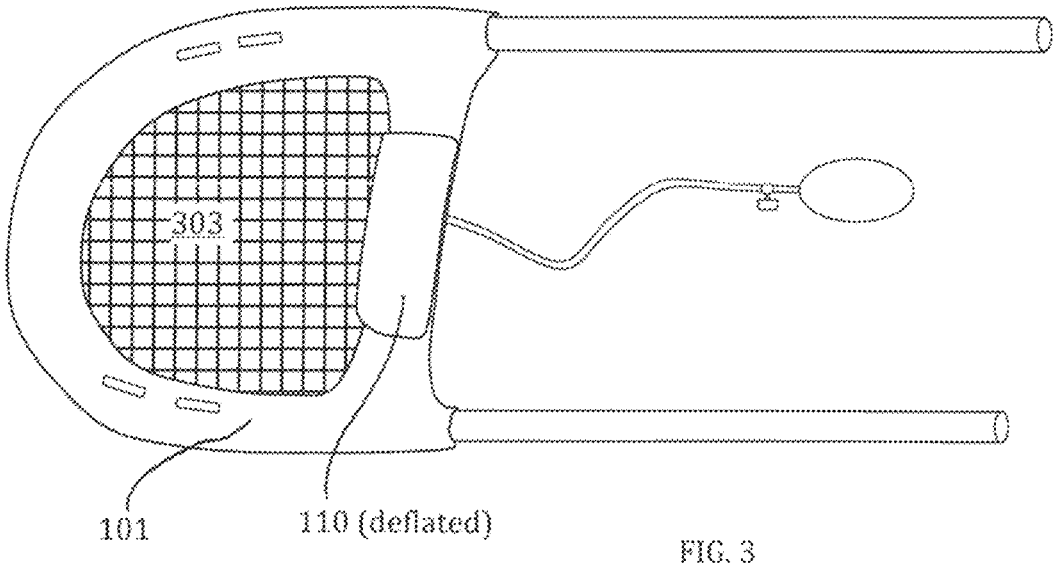
FIG. 3 illustrates a top view of the system in FIG. 1, but includes a mesh within the harness to support the back of a patient's head within the harness and allow fluids to pass through the mesh, and also illustrates the bladder in a deflated state.
Figure 4:
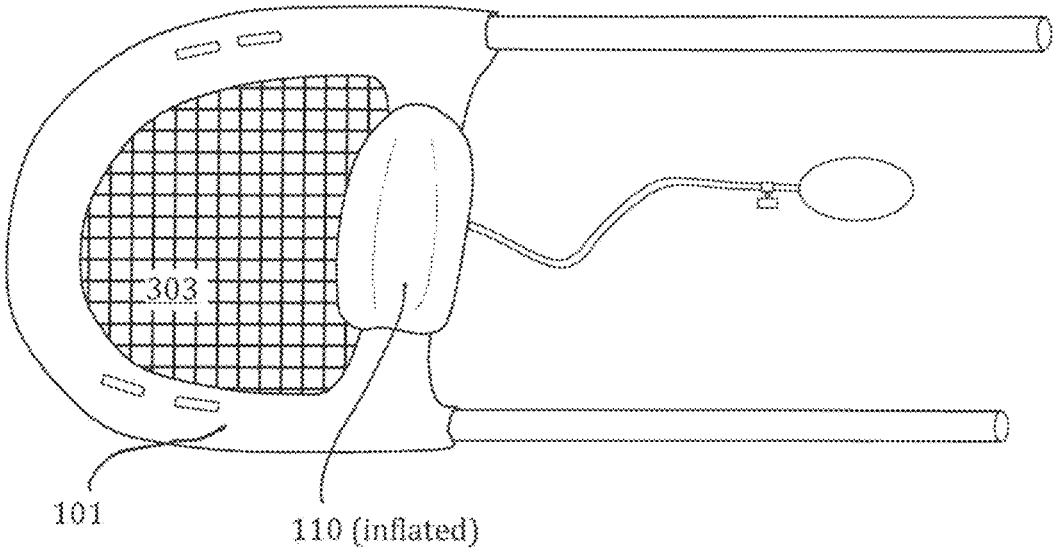
FIG. 4 illustrates perspective views of the rubber bladder in a completely inflated state.

Referring now to FIG. 3, the head-supporting medium can be provided as a mesh 303 integrated within the harness's frame 101 at points of contact surrounding a patient's head. The use of padding/mesh 203 (when/if used) as the head supporting medium 105 and straps 108 can serve to stabilize the patient's head, via contact with at least one of a patient's chin and forehead via the harness's straps 108/208. FIG. 3 further illustrates the adjustable rubber bladder 110 in a deflated state. Referring to FIG. 4, the adjustable rubber bladder is illustrated in an inflate state.

Referring to FIGS. 1-2 and 4, an air reservoir in the form of a neck supporting rubber bladder 110 can be located near the posterior area of the harness whereon the back of a patient's neck will make contact and can be selectively inflated by a pump 111 to elevate and position a patient's neck. Elevating a patient's neck creates an arch of the cervical spine in order to better accommodate surgery. The rubber bladder 110 is initially empty or decompressed before a procedure is started. The rubber bladder 110 can be filled to lift the patient's neck to an appropriate level depending on any of the patient's size, anatomy, or the procedure being performed. As the rubber bladder 110 is filled with air via the pump 111, a patient's neck is supported and can be held at various levels as the rubber bladder 110 is filled with air, or air is released via a release valve 113. The release valve 113 can release air as needed in cooperation with the pump 111 to accomplish variable neck positions and to completely remove air from the rubber bladder 110 when surgery is completed and a patient is being removed from the harness 101.

As described above, the harness 101 can be secured to the operating table in order to better stabilize the patient's head. Referring to FIGS. 1 and 5 the harness 100 can be secured to an operating table 500 with at least one rod, but more likely by rods 120/121, which can be integrated into the frame 101 of the harness 100 on each side of the head holding area. The rods 120/121 can be inserted into rod receivers (not shown) integrated with an operating room table 500. The harness 101 can replace an operating table headpiece 502, which can quickly be removed from the operating table 500 when a cervical spine surgery has to be performed. The harness 101 can be quickly affixed to an operating table 500 by rods (like rods 120/121) of the same dimension and spacing as found in a removed headpiece 502.

The harness 101, straps 108, air bladder 110 and associated pump 111, and mesh 303 can be manufactured using readily available materials. It is preferred that materials allow for the use of imaging (e.g., x-ray, CT) during surgical procedures without interference. The harness 101 can be made of a hardened plastic. Straps 108 can be provided in the form of hook and loop material (e.g., "Velcro™") to firmly secure a patient's head within the hardness and soft padding to stabilize the patient's chin and forehead within the harness. Broadly woven mesh 303 located within the harness at the back of a patient's head can promote drainage of fluids away from a patient and prevent collection within the patients' head and neck areas. The mesh can be a disposable item that can be temporarily attached to the harness. The straps 108 can also be disposable items. The harness 101, however, can be washed (sterilized) and reused in subsequent procedures. The rods 120/121 can be made of stainless steel.

A pneumatic hand pump 111 with a release valve 113 can be similar to those used to inflate blood pressure arm bladders and can be used to fill the rubber bladder with air. It should be appreciated, however, that the bladder can also be filled and air removed using an automated pumping system similar to automated blood pressure pumping systems. Automation of bladder fill can enable remote control of neck positioning by a surgeon or technician during surgery, but can also incorporate sensors to assure that pressure and neck arch height is maintained during surgery.

The invention claimed is:

1. A system for securely positioning a cervical spine during surgery, comprising:

a harness comprising a donut-shaped frame to receive and hold a patients head;

a head-supporting medium comprising a woven mesh to enable fluids to drain away from the patient's head and neck area, the woven mesh attachable to the donut-shaped frame of the harness to receive and hold the patients head;

straps connected to the donut-shaped frame to securely hold the patient's head within the harness and onto the head-supporting medium at at least one of the patient's chin and forehead;

an inflatable bladder disposed on the harness at a location of the harness wherein the inflatable bladder is locatable beneath the patient's neck and positioned such that when inflated, the inflatable bladder elevates the patient's neck to create an arch of the patient's cervical spine in preparation for and during cervical spine surgery; and a pump providing air into the inflatable bladder.

2. The system of claim 1 wherein the harness is formed from a material that does not produce interference with x-rays.

3. The system of claim 2 wherein the harness is formed from a hardened plastic material.

4. The system of claim 1, further comprising a release valve to release air from the inflatable bladder and lower the patient's neck during and after surgery.

5. The system of claim 1, further comprising rods extending from the donut-shaped frame at each side of the inflatable bladder, and configured for insertion into rod receivers of an operating room table and securely affixing the harness to the operating room table.

6. The system of claim 1 further comprising one or more sensors positioned to assure that neck arch height is maintained during a surgical procedure.

7. The system of claim 1 further comprising one or more sensors positioned to assure that pressure exerted by the inflatable bladder is maintained during a surgical procedure.

8. The system of claim 1 wherein the woven mesh is a disposable item that is temporarily attachable to the harness.

9. A system for securely positioning a cervical spine of a patient during surgery, comprising:

a padded harness comprising a donut-shaped frame to receive and hold the patient's head;

a head-supporting medium comprising a woven mesh to enable fluids to drain away from the patient's head and neck area, the woven mesh disposable on the donut-shaped frame of the harness to receive and hold the patient's head;

rods extending from the donut-shaped frame at each side of an inflatable bladder and configured for insertion into rod receivers of an operating room table and securely affixing the harness to the operating room table in place of an operating room table headpiece;

straps connected to the donut-shaped frame to securely hold the patient's head within the harness and onto the head-supporting medium at at least one of the patient's chin and forehead;

the inflatable bladder disposed on the harness locatable beneath the patient's neck;

a pump communicably coupled to provide air into the inflatable bladder, wherein air pumped into the inflatable bladder by the pump elevates the patient's neck to create an arch of the patient's cervical spine in preparation for and during cervical spine surgery; and a release valve to release air from the inflatable bladder and lower the patient's neck during and after surgery.

10. The system of claim 9 wherein the harness is formed from a material that does not produce interference with x-rays.

11. The system of claim 10 wherein the harness is formed from a hardened plastic material.

12. The system of claim 9 wherein the padded harness comprises soft plastic.

13. The system of claim 9 wherein the woven mesh is a disposable item that is temporarily attachable to the harness.

14. The system of claim 9 further comprising one or more sensors positioned to assure that pressure exerted by the inflatable bladder is maintained during a surgical procedure.

15. The system of claim 9 further comprising one or more sensors positioned to assure that neck arch height is maintained during a surgical procedure.

16. The system of claim 9 further comprising one or more sensors positioned to assure that pressure exerted by the inflatable bladder is maintained during a surgical procedure.

17. A system for securely positioning a cervical spine of a patient during surgery, comprising:

a padded or soft plastic harness comprising a donut-shaped frame to receive and hold the patient's head;

a head-supporting medium disposed on the donut-shaped frame of the padded or soft plastic harness to receive and hold the patients head;

rods projecting from the donut-shaped frame at each side of the inflatable bladder and configured for insertion into rod receivers of an operating room table and securely affixing the harness to the operating room table;

straps attachable to the donut-shaped frame to securely hold the patients head within the padded or soft plastic harness and onto the head-supporting medium at at least one of the patients chin and forehead;

an inflatable bladder disposed on the padded or soft plastic harness locatable beneath the patient's neck;

a pump providing air into the inflatable bladder, wherein air pumped into the inflatable bladder by the pump elevates the patient's neck to create an arch of the patient's cervical spine in preparation for and during cervical spine surgery; and a release valve to release air from the inflatable bladder and lower the patient's neck during and after surgery.

18. The system of claim 17, wherein the rods are provided for affixing the harness to the operating room table in place of an operating table headpiece removable from the operating room table.

19. The system of claim 17, wherein the head-supporting medium further comprises a woven mesh to enable fluids to drain away from the patient's head and neck area.

20. The system of claim 17 further comprising one or more sensors positioned to assure that neck arch height is maintained during a surgical procedure.

* * * * *